US006881081B2

(12) United States Patent
Gundermann et al.

(10) Patent No.: US 6,881,081 B2
(45) Date of Patent: Apr. 19, 2005

(54) ELECTRICAL CONNECTOR ASSEMBLY WITH CONNECTION ASSURANCE FEATURES

(75) Inventors: James Edward Gundermann, Palmyra, PA (US); Timothy J. Miller, Warren, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/208,916

(22) Filed: Jul. 31, 2002

(65) Prior Publication Data

US 2004/0023535 A1 Feb. 5, 2004

(51) Int. Cl.[7] ..... H01R 13/62
(52) U.S. Cl. ..... 439/157; 439/372
(58) Field of Search ..... 439/157, 372, 439/160, 153, 352, 489, 557, 549, 152

(56) References Cited

U.S. PATENT DOCUMENTS

| | | | | | |
|---|---|---|---|---|---|
| 5,562,465 | A | * | 10/1996 | Taguchi et al. | 439/157 |
| 5,829,994 | A | | 11/1998 | Oda et al. | 439/157 |
| 6,012,933 | A | * | 1/2000 | Katsuma | 439/157 |
| 6,254,408 | B1 | * | 7/2001 | Hattori et al. | 439/157 |
| 6,325,647 | B1 | | 12/2001 | May et al. | 439/157 |
| 6,332,789 | B1 | * | 12/2001 | Okabe | 439/157 |
| 6,368,125 | B1 | | 4/2002 | Gundermann et al. | 439/157 |
| 6,540,532 | B1 | * | 4/2003 | Martin et al. | 439/157 |
| 6,558,176 | B1 | * | 5/2003 | Martin et al. | 439/157 |
| 2002/0031928 | A1 | | 3/2002 | Gundermann et al. | 439/157 |
| 2003/0017026 | A1 | | 1/2003 | Tachi | 411/157 |

FOREIGN PATENT DOCUMENTS

| | | | |
|---|---|---|---|
| EP | 0 961 361 A2 | 12/1999 | H01R/13/629 |
| EP | 1 191 640 A2 | 3/2002 | H01R/13/629 |

* cited by examiner

*Primary Examiner*—Gary Paumen
*Assistant Examiner*—Edwin A. Leon

(57) ABSTRACT

An electrical connector assembly is provided including first and second housings having ends configured to receive electrical contacts. The first and second housings are configured to be matable with one another to join corresponding electrical contacts. The electrical connector assembly includes a lever member having a cam arm received by the first housing and engaging the second housing as the lever member is rotated through a range of motion from an insertion position to an engaged position. The lever member connects the first and second housings to join corresponding electrical contacts when the lever member is rotated to the engaged position. The lever member has a position assurance tab received by the first housing.

20 Claims, 5 Drawing Sheets

ELECTRICAL CONNECTOR ASSEMBLY WITH CONNECTION ASSURANCE FEATURES

BACKGROUND OF THE INVENTION

Certain embodiments of the present invention relate to connection assurance features on an electrical connector assembly. More particularly, certain embodiments of the present invention relate to connection assurance features that engage a lever and a first housing when the lever is rotated to connect first and second housings.

In certain applications, electronic components require an electrical connector assembly that joins first and second housings containing electrical contacts. One housing includes male electrical contacts, while the other housing includes female electrical contacts. The first housing is configured to receive the second housing such that the male and female electrical contacts are electrically connected.

In the typical electrical connector assembly, the first housing is connected to the second housing by hand. In order to be sure that the first and second housings are properly connected with the electrical contacts electrically engaged, the first and second housings are provided with a latch assembly more generally referred to a as a positioning assurance feature. The latch assembly includes a base plate slidably retained on the first housing beneath a suspended prong and a ramp on the second housing. When the first housing is inserted about the second housing, the prong slides over the ramp and the base plate is then slid over the ramp and the prong into a final position. When the base plate is in the final position, an operator is assured that the first and second housings are fully connected.

However, as the number of electrical contacts to be mated increases, it becomes difficult to fully join the first and second housings because of friction between the mating electrical contacts. Therefore, many electrical connector assemblies include a mate assist assembly that overcomes the frictional resistance involved in mating the first and second housings. The typical mate assist assembly is a lever member connected to one of the housings which has cam arms that engage racks on the other housing as the lever member is rotated through a range of motion. The interaction of the cam arms and the racks provides force to overcome the friction between the electrical contacts and easily connect the first and second housings.

The typical mate assist assembly suffers from a number of drawbacks. A latch assembly connected to the first and second housings can interfere with the lever member of a mate assist assembly. In operation the lever member may appear to be fully rotated to a final position and indicate to an operator that the first and second housings are fully connected when in fact the lever member is not fully rotated to the final position or did not properly engage the racks to connect the first and second housings. The first housing may only loosely be retained about the second housing such that the electrical contacts are not connected or are in danger of becoming unconnected.

Therefore, a need exists for a connector assembly that overcomes the above problems and addresses other concerns experienced in the prior art.

BRIEF SUMMARY OF THE INVENTION

Certain embodiments provide an electrical connector assembly including first and second housings having ends configured to receive electrical contacts. The first and second housings are configured to be matable with one another to join corresponding electrical contacts. The electrical connector assembly includes a lever member having a cam arm received by the first housing and engaging the second housing as the lever member is rotated through a range of motion from an insertion position to an engaged position. The lever member connects the first and second housings to join corresponding electrical contacts when the lever member is rotated to the engaged position. The lever member has a position assurance tab received by the first housing.

Figure 1:
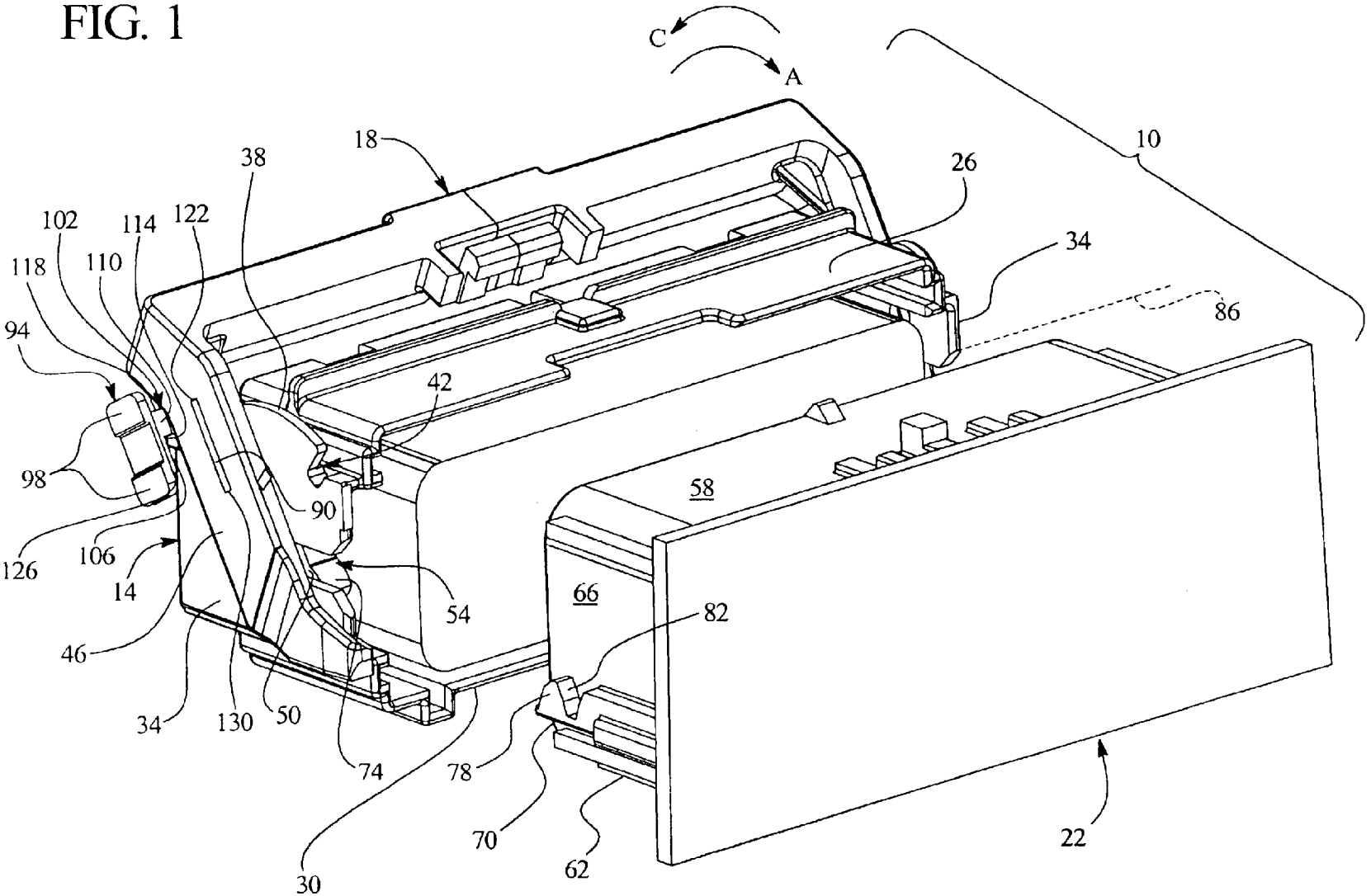
FIG. 1 illustrates an isometric view of an electrical connector assembly formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an isometric view of an electrical connector assembly 10 formed according to an embodiment of the present invention. The electrical connector assembly 10 includes a harness connector 14 connected to a lever member 18 and positioned to receive a header connector 22. The harness connector 14 and header connector 22 carry groups of electrical contacts (not shown). When the harness connector 14 is mounted onto the header connector 22 in an initial staging position (FIG. 3), the lever member 18 is rotated in the direction of arrow A about a rotational axis 86 to move the harness connector 14 from the initial staging position to a final position (FIG. 4) where the harness connector 14 is received by the header connector 22 and the electrical contacts are connected with each other.

The harness connector 14 includes opposite top and bottom walls 26 and 30 formed with opposite side walls 34. A radial top surface 38 with a catch 42 extends from one of the side walls 34. The lever member 18 is shown in an insertion position about the harness connector 14 and is received in apertures 54 in the side walls 34.

Figure 2:
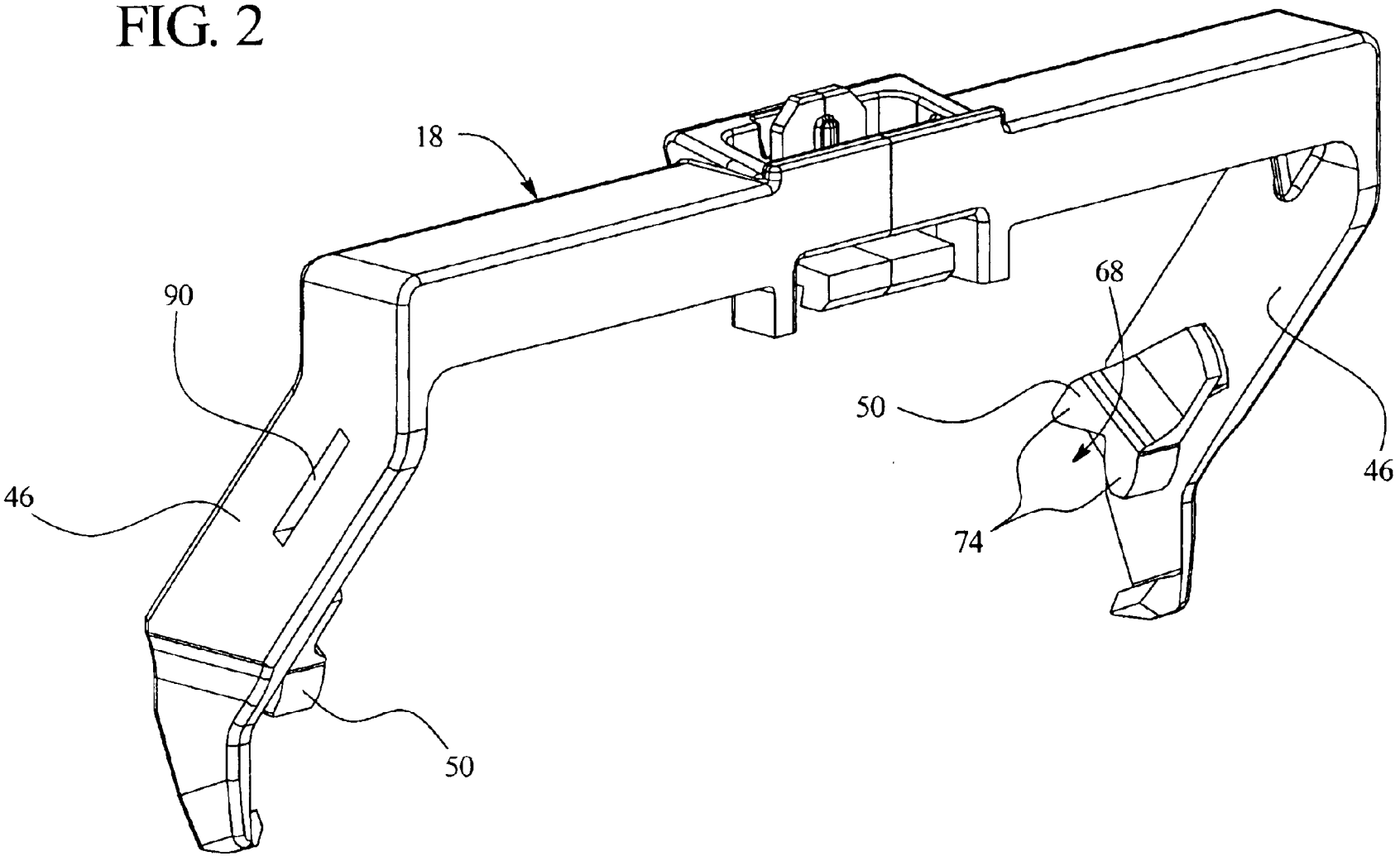
FIG. 2 illustrates an isometric view of the lever member according to an embodiment of the present invention.

FIG. 2 illustrates an isometric view of the lever member 18 according to an embodiment of the present invention. The lever member 18 includes lever arms 46 having cam arms 50 that are rotatably received within the side walls 34 (FIG. 1) of the harness connector 14 (FIG. 1). The cam arms 50 have gear teeth 74 separated by a rack gap 68. The cam arms 50 engage racks 70 (FIG. 1) on the header connector 22 (FIG. 1) as the lever member 18 is rotated to connect the header and harness connectors 22 and 14. A long rectangular slot 90 extends through a lever arm 46 to receive a position assurance tab 94 (FIG. 1).

Returning to FIG. 1, the header connector 22 has opposite top and bottom walls 58 and 62 formed with opposite side walls 66. The racks 70 extend outward from the side walls 66 and each rack 70 has a rack tooth 78 and a tooth gap 82. In operation, when the harness connector 14 is placed on the header connector 22 in the initial staging position and the lever member 18 is rotated in the direction of arrow A about the rotational axis 86, the cam arms 50 engage the racks 70 such that the gear teeth 74 rotate about the rack teeth 78 with the gear teeth 74 entering the tooth gaps 82 and the rack teeth 78 entering the rack gaps 68 (FIG. 2). The interaction between the rack teeth 78 and the gear teeth 74 pulls the harness connector 14 about the header connector 22 and connects the electrical contacts. When the lever member 18 has been fully rotated in the direction of A to connect the harness and header connectors 14 and 22, the harness and header connectors 14 and 22 are in the final position and the lever member 18 is in an engaged position. Alternatively, to disengage the harness and header connectors 14 and 22, the lever member 18 is rotated about the rotational axis 86 in the direction of arrow C.

The lever arm 46 retains the rectangular positioning assurance tab (PAT) 94. The PAT 94 has two push pads 98 on one side and a stop 102 on an opposite side. The stop 102 is L-shaped and has a rectangular base portion 106 and a rectangular extended portion 110. When the lever member 18 is in the insertion position, the PAT 94 is inserted into the slot 90 such that the extended portion 110 extends through the lever arm 46 with a bottom surface 114 of the extended portion 110 resting upon the radial top surface 38 of the side wall 34 and a top surface 118 of the extended portion 110 engaging a top surface 122 of the slot 90. The PAT 94 is thus retained in an upper position within the slot 90. When the lever member 18 is in the engaged position, a bottom surface 126 of the base portion 106 engages a bottom surface 130 of the slot 90. The PAT 94 is thus retained in a lower position within the slot 90.

Figure 3:
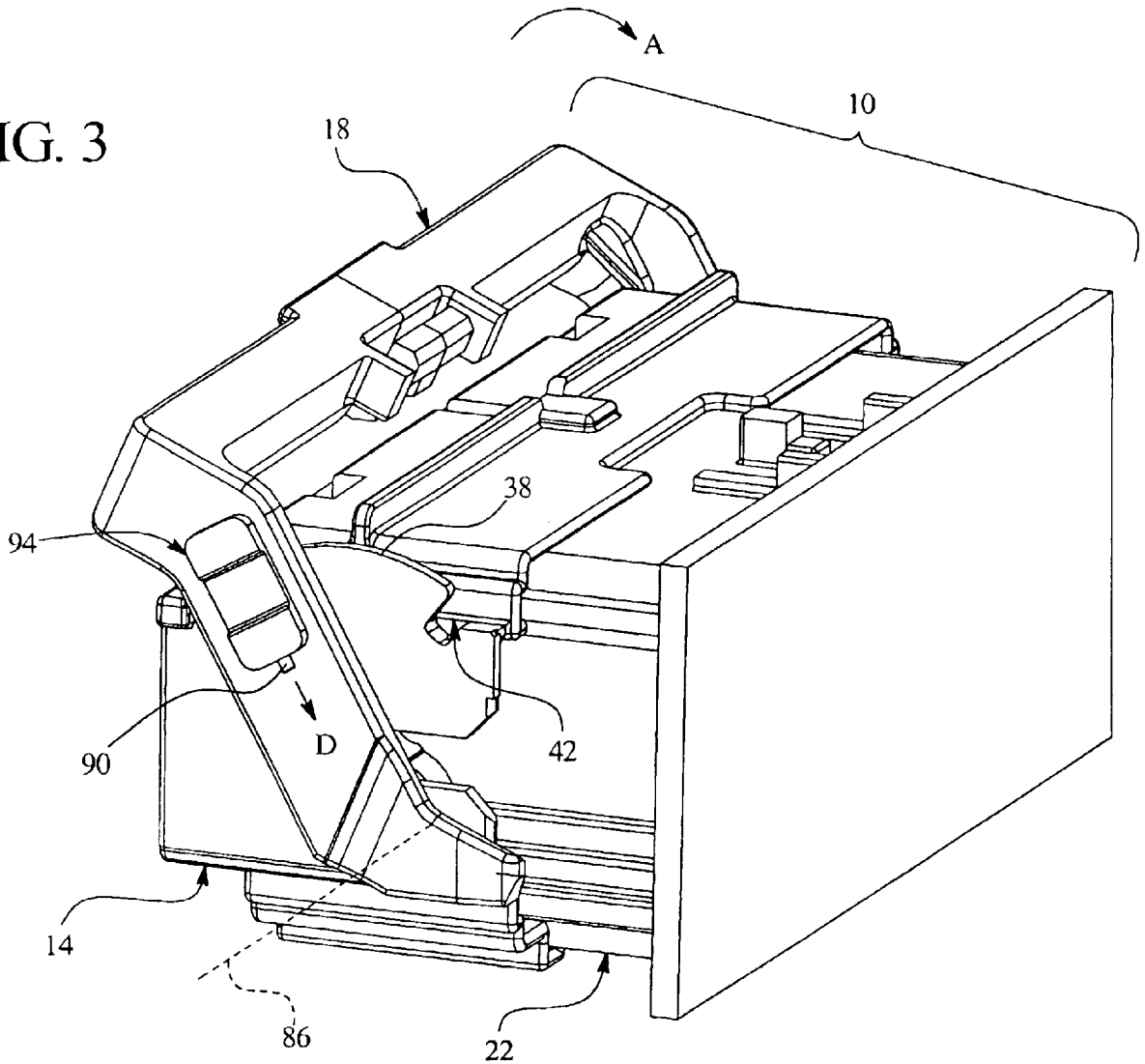
FIG. 3 illustrates the electrical connector assembly in the initial staging position according to an embodiment of the present invention.

FIG. 3 illustrates the electrical connector assembly 10 in the initial staging position according to an embodiment of the present invention. When the harness connector 14 is moved onto the header connector 22 into the initial staging position, the lever member 18 is rotated in the direction of arrow A about the rotational axis 86 to connect the harness and header connectors 14 and 22. As the lever member 18 rotates in the direction of arrow A, the PAT 94 remains in the upper position within the slot 90 with the extended portion 110 (FIG. 1) of the stop 102 (FIG. 1) sliding along the radial top surface 38. When the lever member 18 is rotated to a point above the catch 42 in the radial top surface 38, the PAT 94 slides linearly downward within the slot 90 in the direction of Arrow D relative to the lever arm 46 into the lower position with the extended portion 110 of the stop 102 retained in the catch 42.

Figure 4:
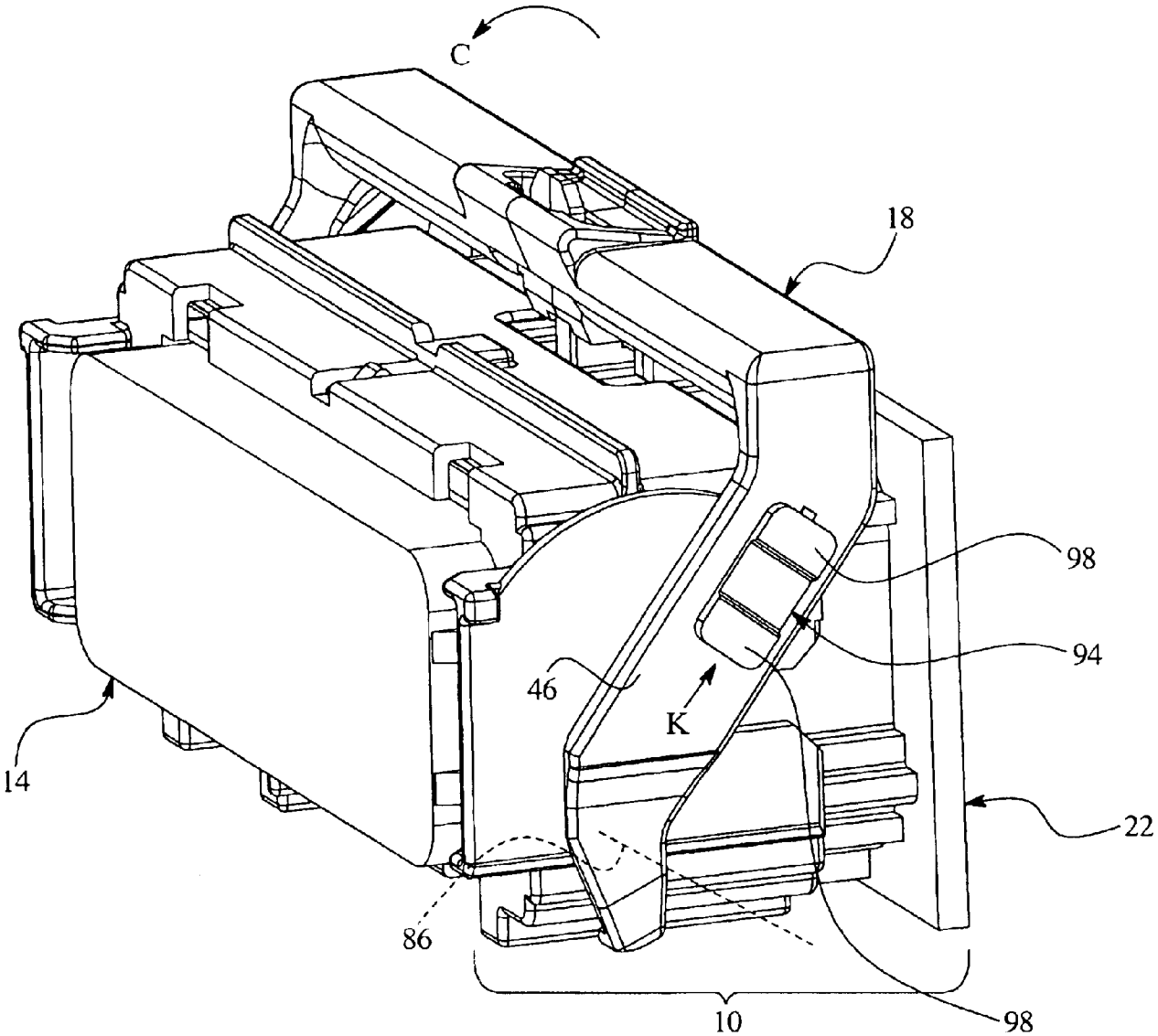
FIG. 4 illustrates an isometric view of the electrical connector assembly in the final position according to an embodiment of the present invention.

FIG. 4 illustrates an isometric view of the electrical connector assembly 10 in the final position according to an embodiment of the present invention. When the PAT 94 is in the lower position, as shown, the lever member 18 is locked in the engaged position with the harness and header connectors 14 and 22 fully connected. Thus, when the PAT 94 is in the lower position, it provides visual assurance to an operator that the harness and header connectors 14 and 22 are in the final position and the electrical contacts are connected. Alternatively, the lever member 18 may be released from the engaged position by moving the push pads 98 in the direction of arrow K with respect to the lever arm 46 to move the PAT 94 from the lower position to the upper position and thus remove the extended portion 110 (FIG. 1) from the catch 42 (FIG. 1). When the extended portion 110 is out of the catch 42, the lever member 18 may be rotated about the rotational axis 86 in the direction of arrow C to disengage the harness connector 14 from the header connector 22.

Figure 5:
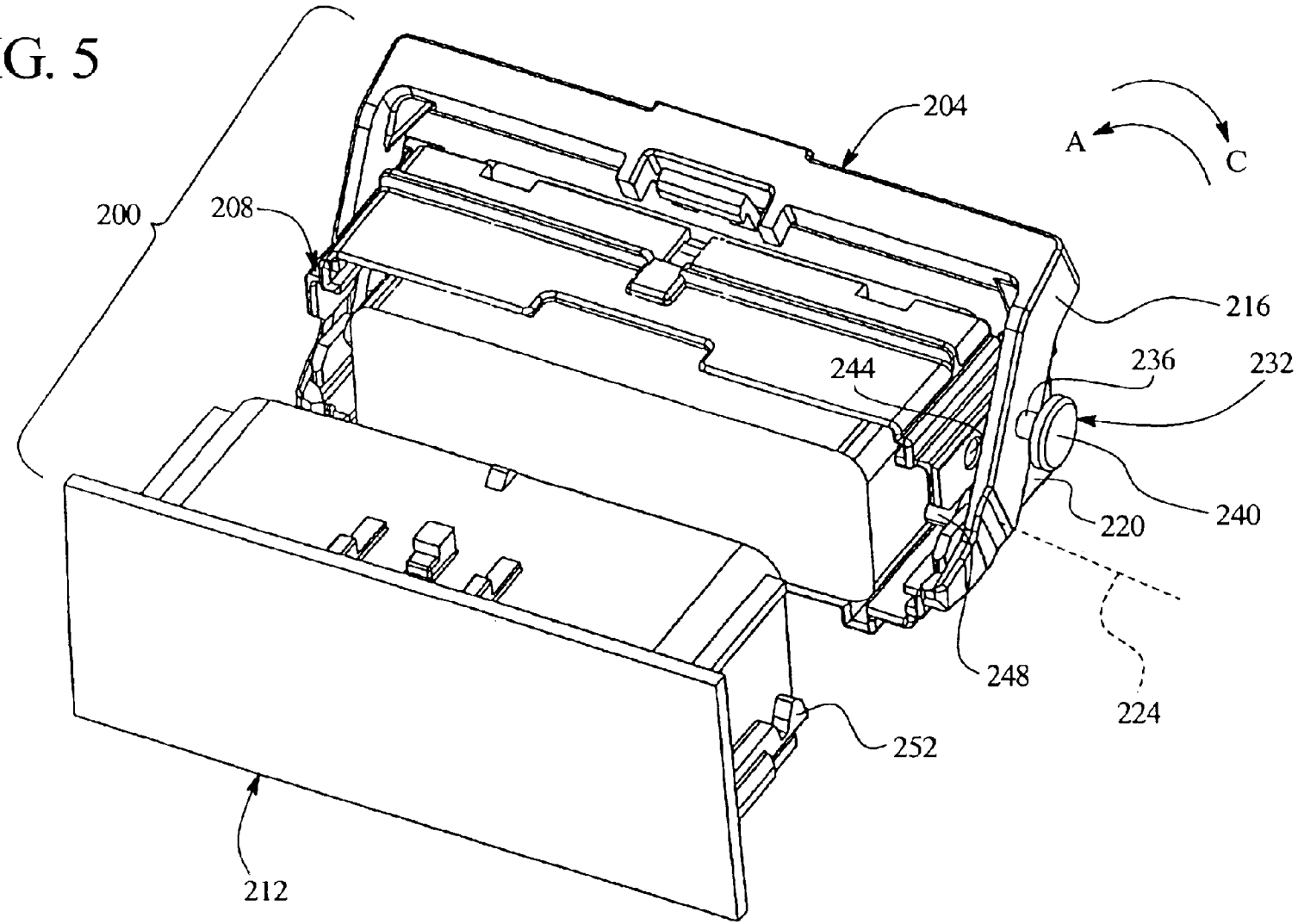
FIG. 5 illustrates an isometric view of an electrical connector assembly formed according to an embodiment of the present invention.

FIG. 5 illustrates an isometric view of an electrical connector assembly 200 formed according to an embodiment of the present invention. The connector assembly 200 includes a lever member 204, a harness connector 208, and a header connector 212. The lever member 204 is in the insertion position and has lever arms 216 that are rotatably retained within side walls 220 of the harness connector 208. The lever arms 216 include cam arms 248 that engage racks 252 on the header connector 212 as described above. The harness connector 208 receives the header connector 212 and is fully connected to the header connector 212 when the lever member 204 is rotated in the direction of arrow A about a rotational axis 224 from the insertion position to the engaged position.

A lever arm 216 includes an aperture (not shown) receiving a knob-shaped PAT 232. The PAT 232 includes a post 236 formed with a handle 240, and the post 236 extends through the aperture. The side wall 220 of the harness connector 208 has a catch or post hole 244 situated therein. As the lever member 204 is rotated about the rotational axis 224 in the direction of arrow A from the insertion position to the final position, the handle 240 is pressed inward against the lever arm 216 such that the post 236 slides against the side wall 220 until the post 236 is positioned over the post hole 244. The post 236 then slides into the post hole 244 and the handle 240 slides inward against the lever arm 216. The PAT 232 is thus locked within the post hole 244 such that the lever member 204 is in the engaged position and may not be rotated about the rotational axis 224 in any direction. When the lever member 204 is in the engaged position, the harness and header connectors 208 and 212 are in the final position and the electrical contacts are fully connected. Therefore, the PAT 232 serves to lock the lever member 204 in the engaged position and provide visual assurance that the harness and header connector 208 and 212 are fully connected.

Alternatively, the lever member 204 may be released from the engaged position by moving the handle 240 outward away from the lever arm 216 such that the post 236 is withdrawn from the post hole 244. When the post 236 is out of the post hole 244, the lever member 204 may be rotated about the rotational axis 224 in the direction of arrow C to disengage the harness connector 208 from the header connector 212.

The connector assembly of the various embodiments provides several benefits. First, the PATs provide visual assurance to an operator that the lever member is in an engaged position such that the harness connector and header connector are fully engaged in a final position and the electrical contacts are connected. Thus, the operator knows that the harness connector will not become disengaged from the header connector or that the electrical contacts will become disengaged. Secondly, the PATs lock the lever member in the engaged position, and the lever member may not be removed from the engaged position unless the PATs are manipulated to unlock the lever member. Thus, the lever members are not free to rotate and disengage the harness and header connectors and the electrical contacts. Also, the location of the PATs on the lever member takes up little space and does not interfere with the rotation of the lever member or the connection of the harness and header connectors. Further, the PATs are easy to manufacture and may be pre-assembled to the lever members before connecting the lever member to the harness connector such that the lever members may be shipped separately form the harness and header connectors.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

first and second housings having ends configured to receive electrical contacts, said first and second housings being configured to be matable with one another to join corresponding electrical contacts;

a lever member including a cam arm received by said first housing and engaging said second housing as said lever member is rotated through a range of motion from an insertion position to an engaged position, said lever member connecting said first and second housings to join corresponding electrical contacts when said lever member is rotated to said engaged position, said lever member having a position assurance tab slidably coupled to said lever member and received by said first housing to lock said lever member in the engaged position when the first and second housing are fully mated.

2. The electrical connector assembly of claim 1, wherein said first housing includes a catch for receiving said position assurance tab as said lever member is rotated through said range of motion.

3. The electrical connector assembly of claim 1, wherein said lever member includes a lever arm having a slot and said position assurance tab includes a stop, said slot retaining said stop such that said stop slides within said slot between an upper position at which said lever member is rotatable between said insertion and engaged positions and a lower position at which said lever member is in said engaged position.

4. The electrical connector assembly of claim 1, wherein said lever member includes a lever arm having a slot and said position assurance tab includes a stop, said stop being defined by a base portion and an extended portion, said base portion being retained in said slot and engaging a bottom of said slot when said position assurance tab is in a catch on said first housing, said extended portion extending through said slot and slidably engaging a top of said first housing as said lever member is rotated between said insertion position and said engaged position.

5. The electrical connector assembly of claim 1, wherein said first housing includes a side wall having a top and said position assurance tab includes a stop retained in a slot in said lever member, said stop sliding along said top as said lever member is rotated between said insertion and engaged positions.

6. The electrical connector assembly of claim 1, wherein said first housing includes a side wall having a radial top surface, a catch being located along said radial top surface such that said position assurance tab slides along said radial top surface and into said catch as said lever member is rotated from said insertion position to said engaged position along said side wall, said catch retaining said stop to secure said lever member in said engaged position.

7. The electrical connector assembly of claim 1, wherein said position assurance tab includes a stop received in a slot in said lever member, said stop being in a lower position within said slot when said stop is in a catch, said stop including a push pad that is moved from said lower position to an upper position within said slot such that said lever member is freely rotatable from said engaged position.

8. The electrical connector of claim 1, wherein a catch is located on a side wall of said first housing and is circular in shape and said position assurance tab has a cylindrical post, said catch securing said post when said lever member is in said engaged position such that said lever member is secured in said engaged position.

9. The electrical connector assembly of claim 1, wherein said lever member includes a lever arm having an aperture and said position assurance tab includes a post, said aperture receiving said post such that said post is slidable through said aperture to engage a catch.

10. The electrical connector assembly of claim 1, wherein said lever member includes a lever arm having an aperture and said position assurance tab includes a post formed with a handle such that when said lever member is rotated to said engaged position, said handle is moved inward toward said first housing to slide said post through said aperture and into a catch with said handle sliding into contact with said lever arm.

11. The electrical connector assembly of claim 1, wherein said position assurance tab includes a post and handle retained in an aperture in said lever member, said post being in a catch when said lever member is in said engaged position, said post being removed from said catch by moving said handle outward away from said lever member such that said lever member is freely rotatable from said engaged position.

12. The electrical connector assembly of claim 1, wherein said lever member includes a lever arm having an aperture and said position assurance tab includes a post, said post extending through said aperture such that said post slidably engages a side wall of said first housing as said lever member is rotated between said insertion and engaged positions along said side wall and is received by a catch when said lever member is in said engaged position.

13. An electrical connector assembly comprising:

first and second housings having ends configured to receive electrical contacts, said first and second housings being configured to be matable with one another to join corresponding electrical contacts;

a lever member including a cam arm received by said first housing and engaging said second housing as said lever member is rotated through a range of motion from an insertion position to an engaged position, said lever member connecting said first and second housings to join corresponding electrical contacts when said lever member is rotated to said engaged position, said lever member having a slot receiving a stop extending from a position assurance tab slidably coupled to said lever member; and said first housing having a catch along a radial top surface for receiving and retaining said stop as said lever member is rotated through said range of motion to lock said lever member in the engaged position when the first and second housings are fully mated.

14. The electrical connector assembly of claim 13, said stop is defined by a base portion and an extended portion, said base portion being retained in said slot and engaging a bottom of said slot when said position assurance tab is in said catch, said extended portion extending through said slot and slidably engaging said radial top surface of said first housing as said lever member is rotated between said insertion position and said engaged position.

15. The electrical connector assembly of claim 13, wherein said slot extends through a lever arm, said slot retaining said stop such that said stop slides within said slot between an upper position at which said lever member is rotatable between said insertion and engaged positions and a lower position at which said lever member is in said engaged position.

16. The electrical connector assembly of claim 13, wherein said radial top surface extends along a side wall of said first housing, said catch being located along said radial top surface such that said stop slides along said radial top surface and into said catch as said lever member is rotated from said insertion position to said engaged position along said side wall, said catch retaining said stop to secure said lever member in said engaged position.

17. An electrical connector assembly comprising:

first and second housings having ends configured to receive electrical contacts, said first and second housings being configured to be matable with one another to join corresponding electrical contacts;

a lever member including a cam arm received by said first housing and engaging said second housing as said lever member is rotated through a range of motion from an insertion position to an engaged position, said lever member connecting said first and second housings to join corresponding electrical contacts when said lever member is rotated to said engaged position, said lever member having an aperture receiving a post extending from a position assurance tab on said lever member; and said first housing having a post hole on a side wall for receiving and retaining said post as said lever member is rotated through said range of motion to lock said lever member in the engaged position when the first and second housings are fully mated.

18. The electrical connector of claim 17, wherein said post hole is circular and said post is cylindrical, said post hole receiving said post when said lever member is in said engaged position such that said lever member is secured in said engaged position.

19. The electrical connector of claim 17, wherein said post is formed with a handle such that when said lever member is rotated to said engaged position, said handle is moved inward toward said first housing to slide said post through said aperture and into said post hole with said handle sliding into contact with said lever arm.

20. The electrical connector assembly of claim 17, wherein said post is formed with a handle, said post being in said post hole when said lever member is in said engaged position, said post being removed from said post hole by moving said handle outward away from said lever member such that said lever member is freely rotatable from said engaged position.

* * * * *